US005718529A

United States Patent [19]

Chan

[11] Patent Number: 5,718,529

[45] Date of Patent: Feb. 17, 1998

[54] RING BINDER

[75] Inventor: Keung Chan, Dongguan, China

[73] Assignee: Leco Stationary Manufacturing Company Limited, Kwai Chung, Hong Kong

[21] Appl. No.: 818,081

[22] Filed: Mar. 14, 1997

[30] Foreign Application Priority Data

| | | | |
|---|---|---|---|
| May 21, 1996 | [EP] | European Pat. Off. | 963036363 |
| Jul. 31, 1996 | [EP] | European Pat. Off. | 963056593 |

[51] Int. Cl.[6] ..... B42F 3/04

[52] U.S. Cl. ..... 402/36; 402/38; 402/41

[58] Field of Search ..... 402/36, 38, 39, 402/41, 31, 26

[56] References Cited

U.S. PATENT DOCUMENTS

| | | | |
|---|---|---|---|
| 3,135,266 | 6/1964 | Bouhier | 402/38 |
| 3,884,586 | 5/1975 | Michaelis et al. | 402/38 |
| 4,571,108 | 2/1986 | Vogl | 402/38 |
| 5,346,325 | 9/1994 | Yamanoi et al. . | |

FOREIGN PATENT DOCUMENTS

| | | |
|---|---|---|
| 31 19 779 | 12/1982 | Germany . |
| 270400 | 10/1983 | Taiwan . |
| 2 254 828 | 10/1992 | United Kingdom . |
| 2255316 | 11/1992 | United Kingdom . |
| 2255529 | 11/1992 | United Kingdom . |
| 2276023 | 8/1994 | United Kingdom . |
| 2289240 | 11/1995 | United Kingdom . |

*Primary Examiner*—Willmon Fridie, Jr.

*Attorney, Agent, or Firm*—Pollock, Vande Sande & Priddy

[57] ABSTRACT

A ring binder is disclosed as comprising a substantially rigid curved upper plate supporting a pair of lower plates to which at least two pairs of half-ring members are mounted, the pair of lower plates being pivotally movable between a first position in which the half-ring members are closed, and a second position in which the half-ring members are open, and a lock to lock at least one of the pairs of half-ring members whilst closed, and the lock is supported by the curved upper plate between the two pairs of half-ring members.

24 Claims, 16 Drawing Sheets

RING BINDER

This invention relates to a ring binder and in particular, a ring binder including a substantially rigid upper structure supporting a pivotable lower structure, to which a number of pairs of half-rings are mounted.

Existing ring binders include different kinds of locking mechanisms for preventing accidental opening of the pairs of half-rings, thus allowing paper to fall off the binders. In the absence of a locking mechanism, if the ring binder is in a vertical position, the paper may force the pairs of half-rings to open, thus trapping one or more sheets of paper therebetween. In addition, if there is no proper locking mechanism, in case the ring binder is turned over when holding a large amount of paper, the paper may, by virtue of its weight, force the pairs of half-rings to open.

There are existing ring binders including at either end thereof a lever which is operable to pivot the lower plates to selectively open and/or close pairs of ring members mounted on the plates. Such levers are movable among a first position in which the pairs of ring members are closed and are locked against any force applied thereon, a second position in which the pairs of ring members are closed but may be opened by force applied on any of the pairs of ring members, and a third position in which the pairs of ring members are open.

According to the present invention, there is provided a ring binder comprising a substantially rigid upper structure supporting a lower structure to which at least two pairs of half-ring members are mounted, the lower structure being pivotally movable between a first position in which the half-ring members are closed, and a second position in which the half-ring members are open, and lock means to lock at least one of the pairs of half-ring members whilst closed, characterized in that the lock means is supported by the upper structure between the two pairs of half-ring members.

Advantageously, the lock means may be supported by at least one inturned part of the upper structure.

Conveniently, the lock means may be supported by the upper structure substantially along its middle line.

Suitably, the upper structure may comprise groove means for receiving therein at least part of the lock means.

The groove means may advantageously be provided in the underside surface of the upper structure.

The upper structure may conveniently comprise ridge means on its upperside surface.

The lock means may suitably be swivellably movable relative the upper structure.

Advantageously, the lock means may be movable between a locked position in which the lower structure is locked against movement from the first position to the second position, and an unlocked position in which the lower structure is movable from the first position to the second position.

Conveniently, the lock means may comprise at least one lock member which, when the lock means is in its locked position, engages the lower structure against pivotal movement.

Suitably, the lock means may comprise two lock members.

The lock member(s), in its locked position, may advantageously engage an upper surface of the lower structure.

The lower structure may conveniently comprise stopping means against which the lock member(s) engages when the lock means is in its locked position.

The lower structure may suitably comprise aperture means for receiving at least part of the lock member(s) when the lower structure moves from its first position to its second position.

Advantageously, the lock means may comprise a key member operable to move the lock means from the locked position to the unlocked position.

Conveniently, the key member may be operable to disengage the lock member(s) from the lower structure.

Suitably, the key member may be operable to disengage the lock member(s) from the upper surface of the lower structure.

The key member may advantageously be operable to disengage the lock member(s) from the stopping means.

The key member may conveniently be fixedly engaged with the lock member(s) for simultaneous movement.

The key member may suitably comprise a sloped portion upon which the lower structure acts when the lower structure moves from its first position to its second position.

Advantageously, when the sloped position of the key member is acted upon by the lower structure, the lock member(s) may be movable from its locked position to its unlocked position.

Conveniently, the lower structure may comprise hole means for receiving at least part of the key member when the lower structure moves from its first position to its second position.

Suitably, the key member may comprise a wire element.

The binder may advantageously comprise securing means adapted to secure the ring binder to a base member.

The securing means may conveniently be integrally formed with the upper structure.

The invention will now be described, by way of examples only, with reference to the accompanying drawings, wherein.

As shown in FIGS. 1 to 8B, a ring binder according to a first embodiment of the present invention is generally designated as 10. The ring binder 10 includes an upper casing 12 supporting a pair of plates 14*a* and 14*b* to which three pairs of half-rings 16*a*, 16*b* and 16*c* are mounted. The plates 14*a* an 14*b* are pivotally movable relative to each other, so that the pairs of half-rings 16*a*, 16*b* and 16*c* may be selectively opened or closed. The half-rings 16*a*, 16*b* and 16*c* extend through three pairs of slots 18*a*, 18*b* and 18*c* on the upper casing 12, which allow the half-rings 16*a*, 16*b* and 16*c* to open or close. At each end of the ring binder 10 is a hole 20*a* and 20*b*, through which a rivet (not shown) may be received to secure the ring binder 10 to an article (not shown), e.g. a paperboard/plastic/metal cover.

Figure 1:
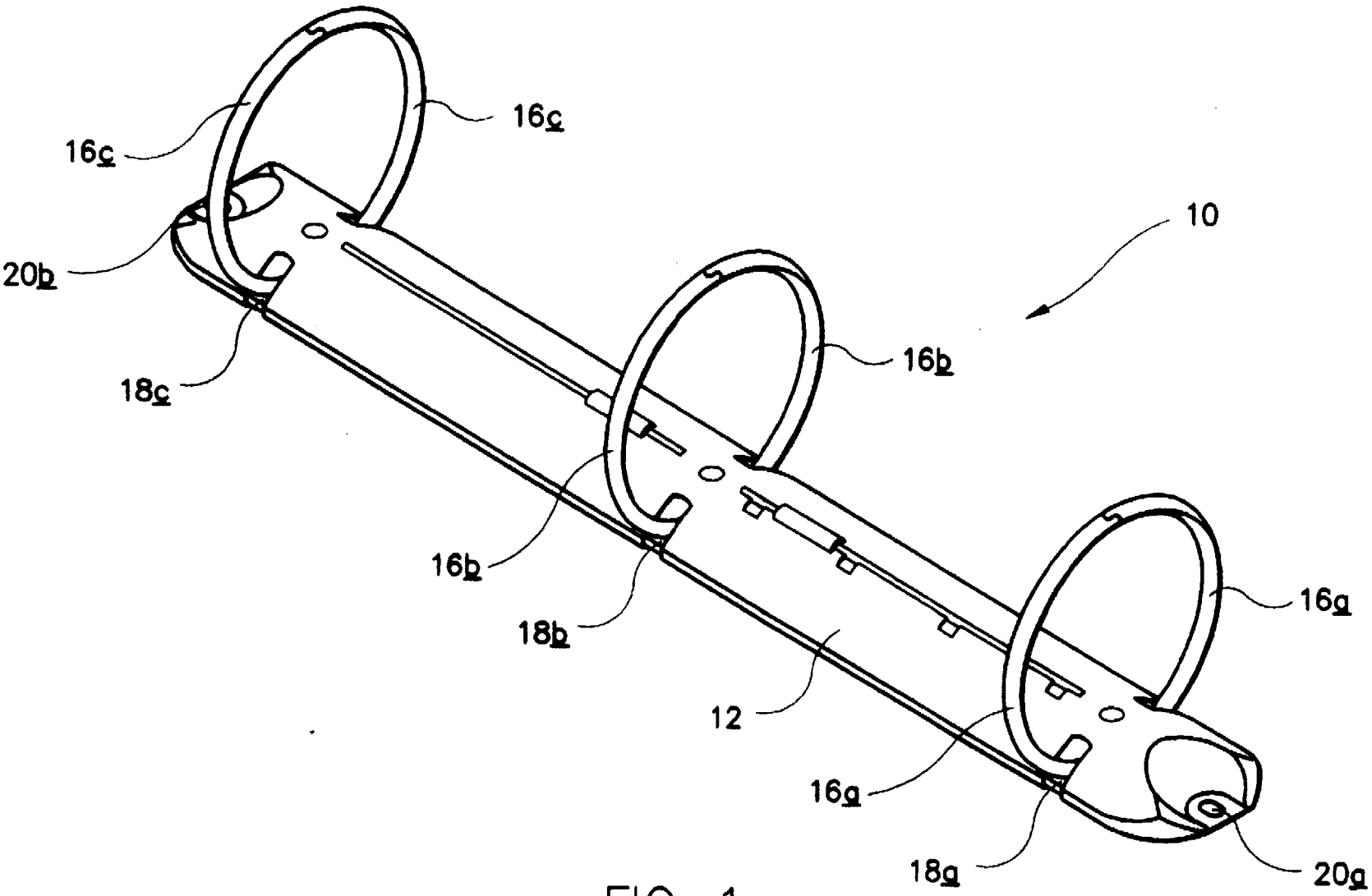
FIG. 1 shows a top perspective view of a first en embodiment of a ring binder according to the present invention with the half-rings in a closed position.
Figure 2:
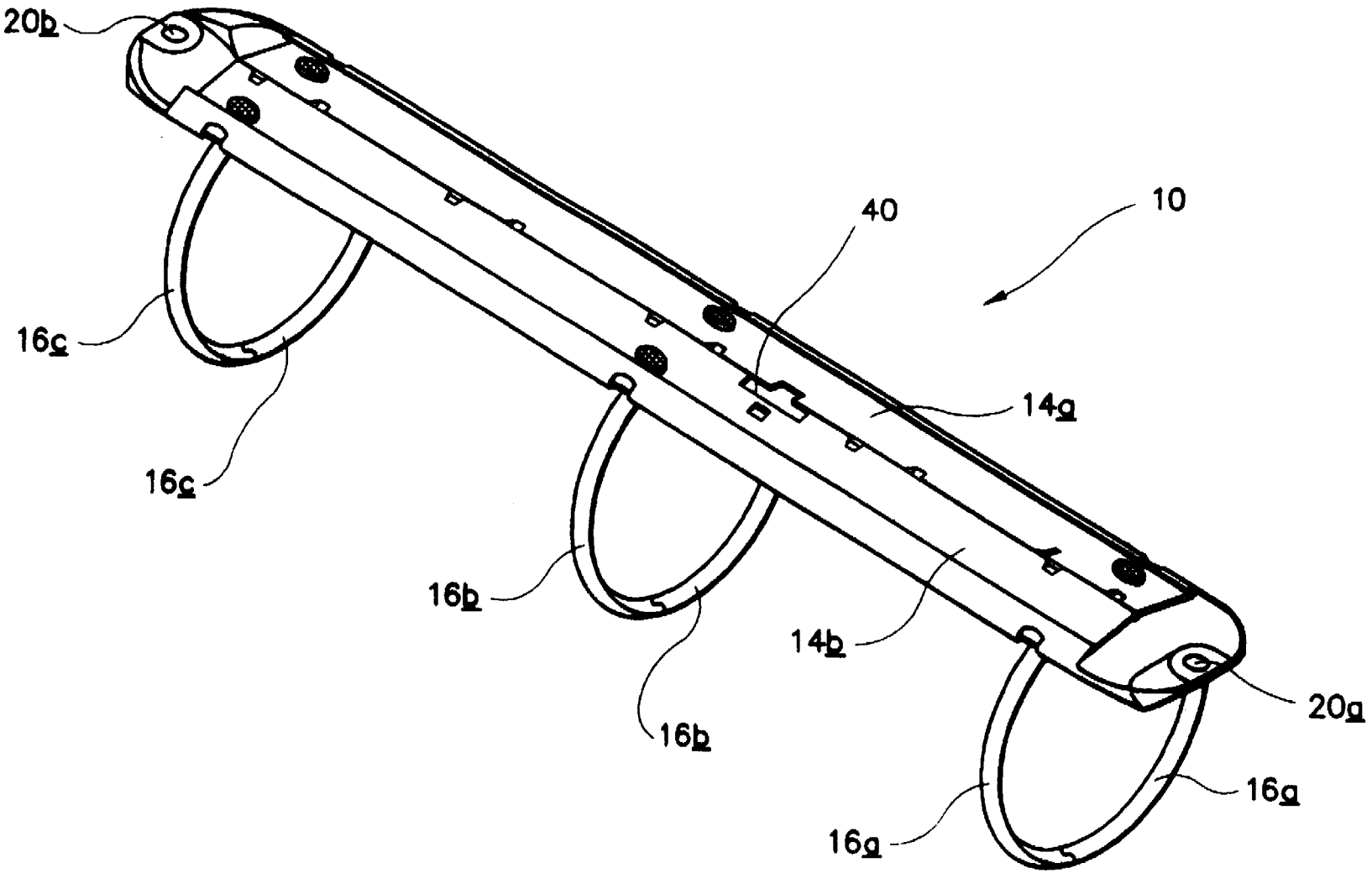
FIG. 2 shows a bottom perspective view of the ring binder shown in FIG. 1.
Figure 3:
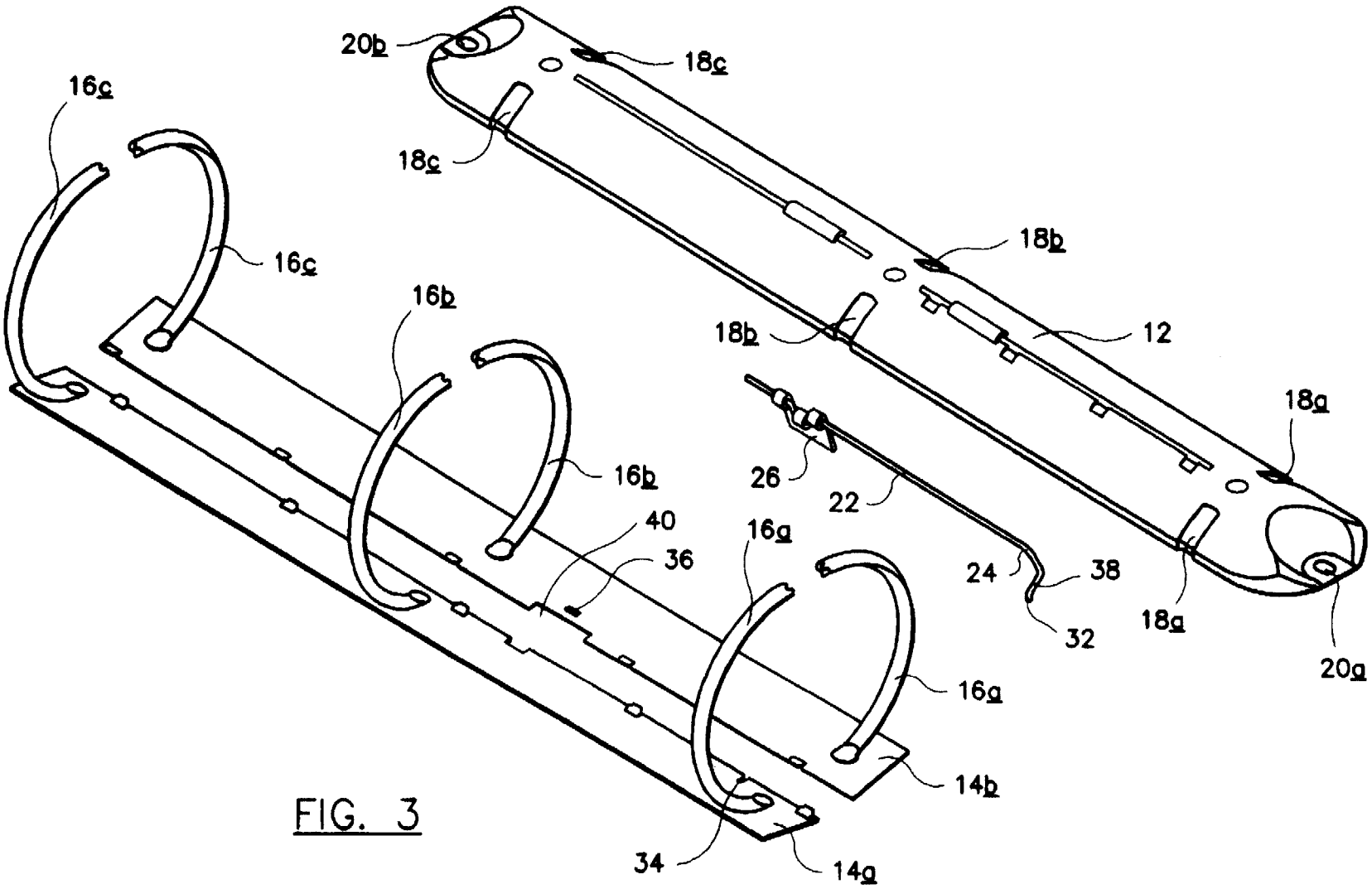
FIG. 3 shows an exploded view of the ring binder shown in FIG. 1.
Figure 4:
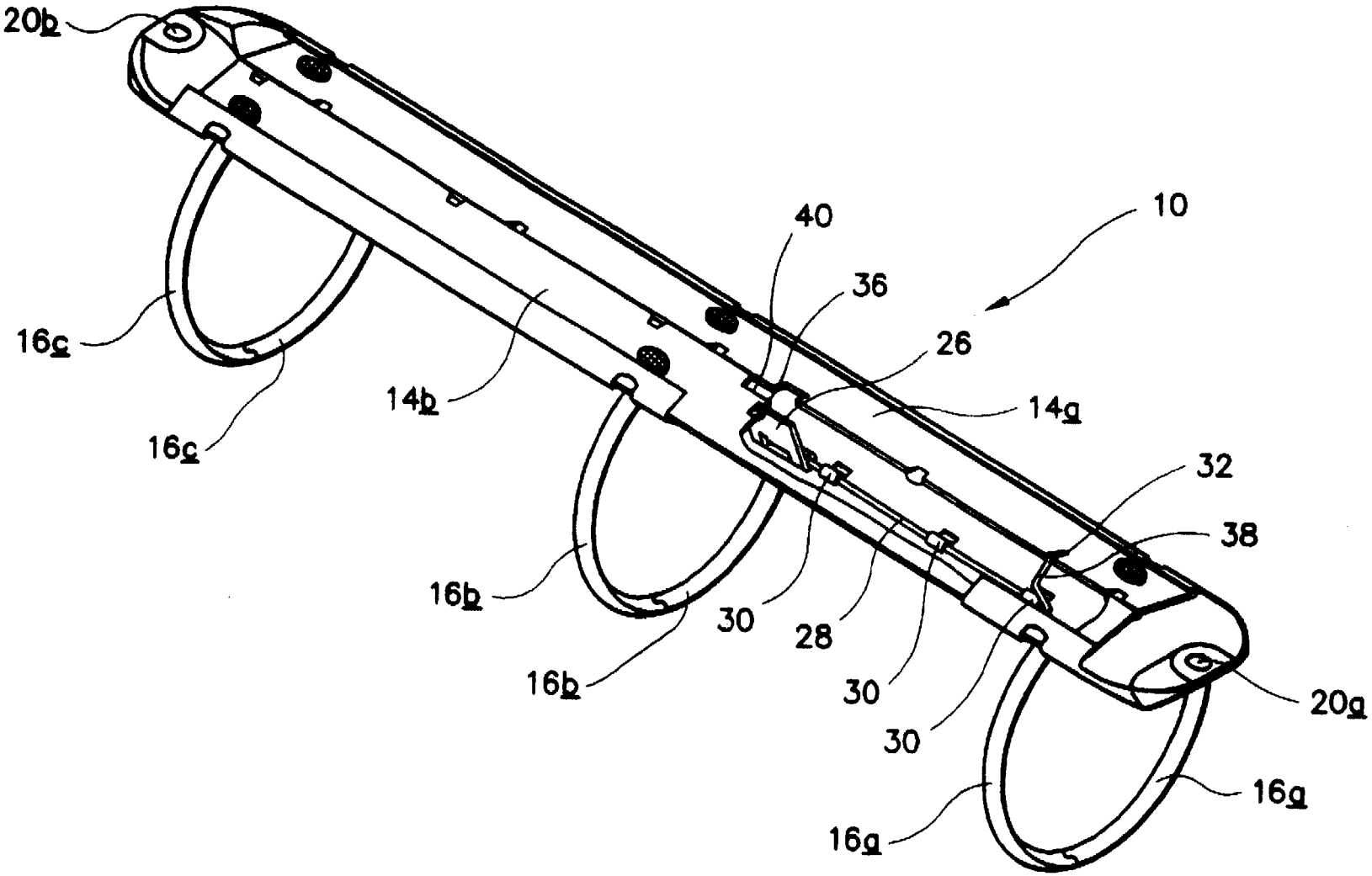
FIG. 4 shows a bottom perspective view of the ring binder shown in FIG. 1, with part of the lower structure removed for clarity purposes.
Figure 5:
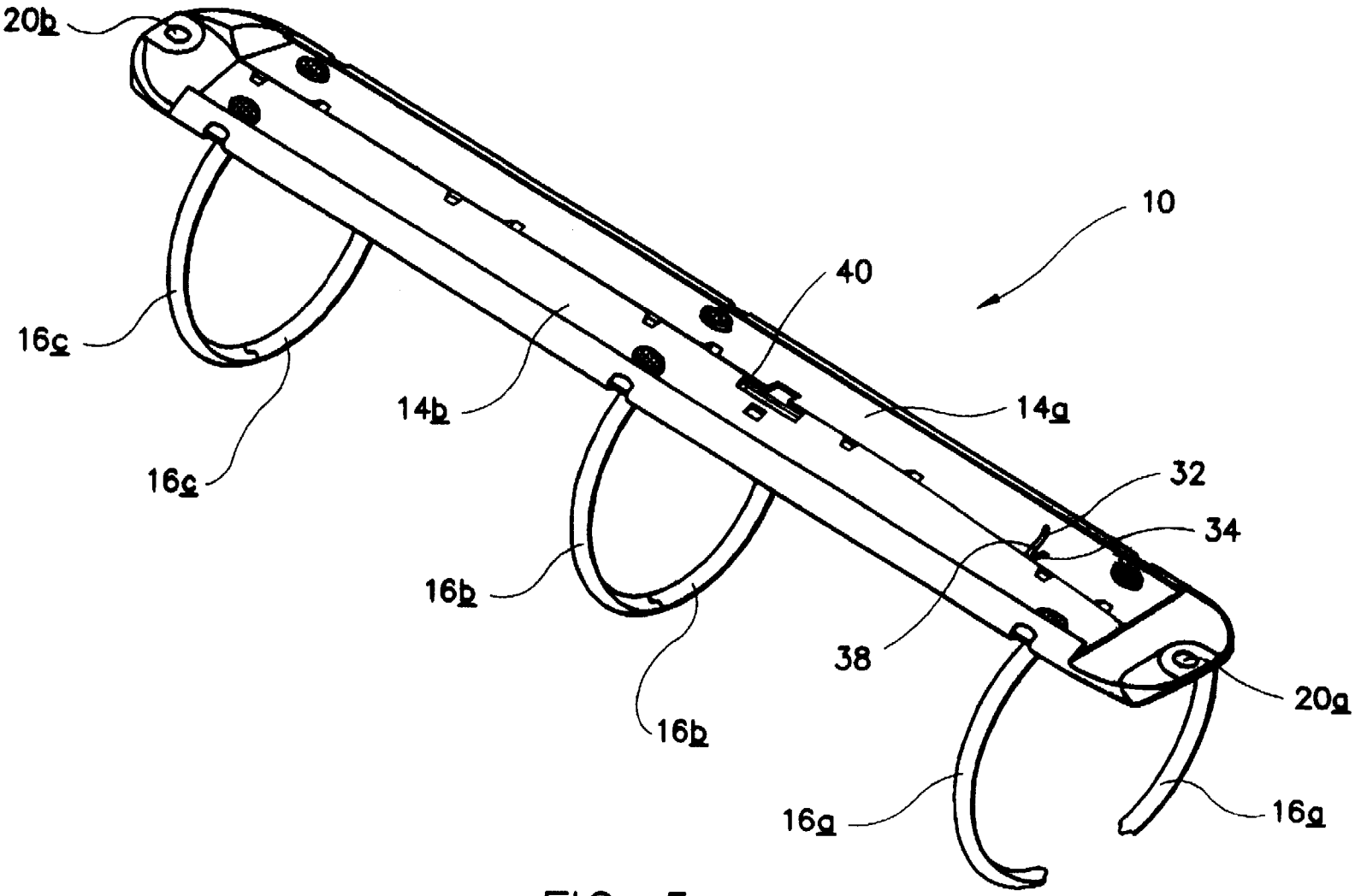
FIG. 5 shows the ring binder of FIG. 1 with its lower structure in a partly moved position.
Figure 6:
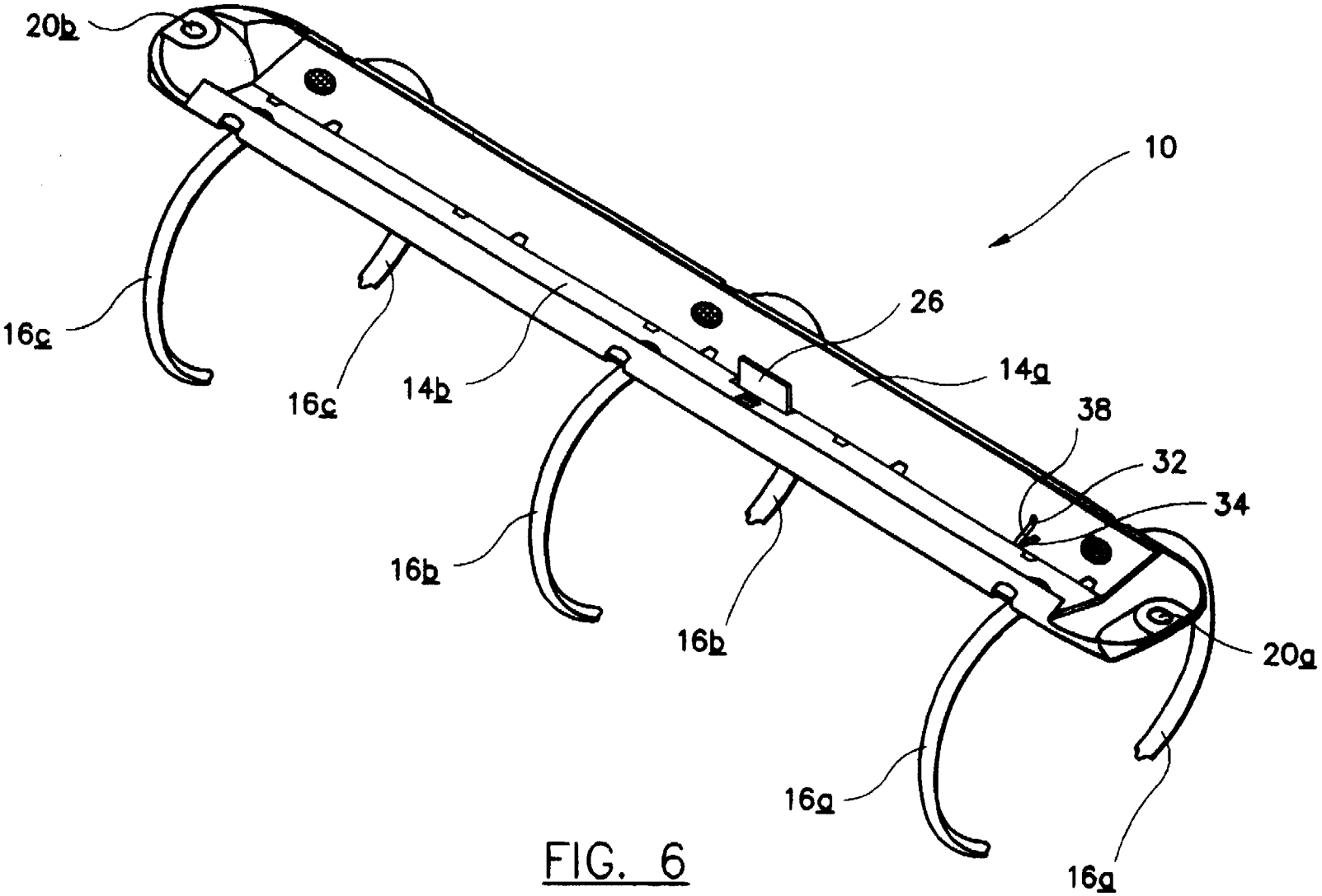
FIG. 6 shows the ring binder of FIG. 1 with the half-rings in an open position.
Figure 7B:
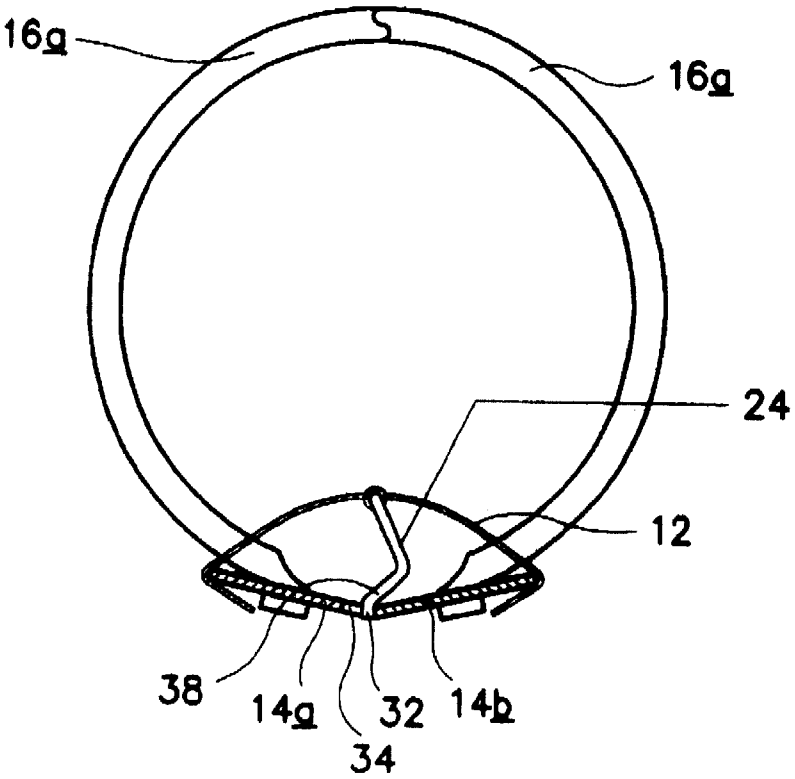
FIG. 7B shows a transverse sectional view of the ring binder shown in FIG. 1 across the key member with the half-rings in the closed position.
Figure 7A:
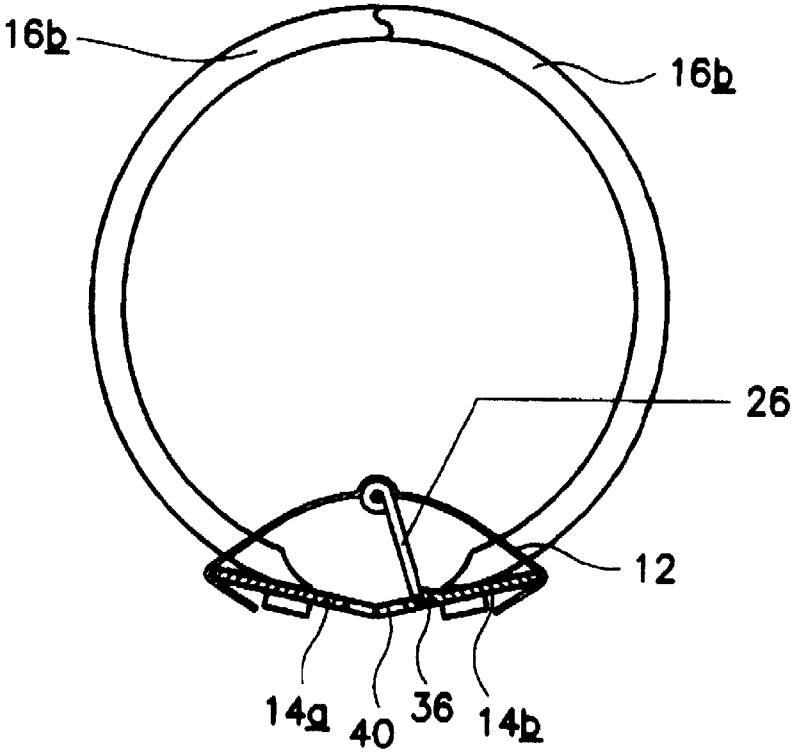
FIG. 7A shows a transverse sectional view of the ring binder shown in FIG. 1 across the lock member with the half-rings in the closed position.

As shown more clearly in FIG. 3, the ring binder 10 includes a lock 22 including a wire 24 with a lock element 26 fixedly crimped hereon. As shown in FIG. 4, the wire 24 includes a shaft 28 which is secured to lower surface of the upper casing 12 by three inturned parts 30 crimped therewith. The lock 22 is thus supported by the upper casing 12 along its middle line and between the half-rings 16*a* and 16*b*. The lock 22, the wire 24 and the lock element 26 are thus allowed to swivel about the longitudinal axis of the shaft 28.

Figure 8B:
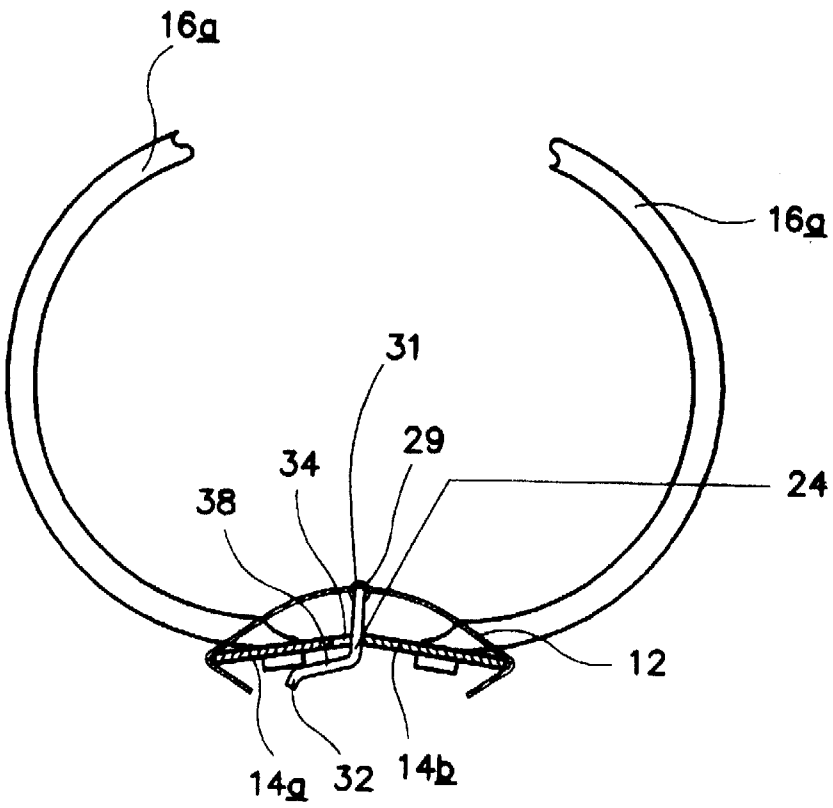
FIG. 8B shows a transverse sectional view of the ring binder shown in FIG. 1 across the key member with the half-rings in the open position.
Figure 8A:
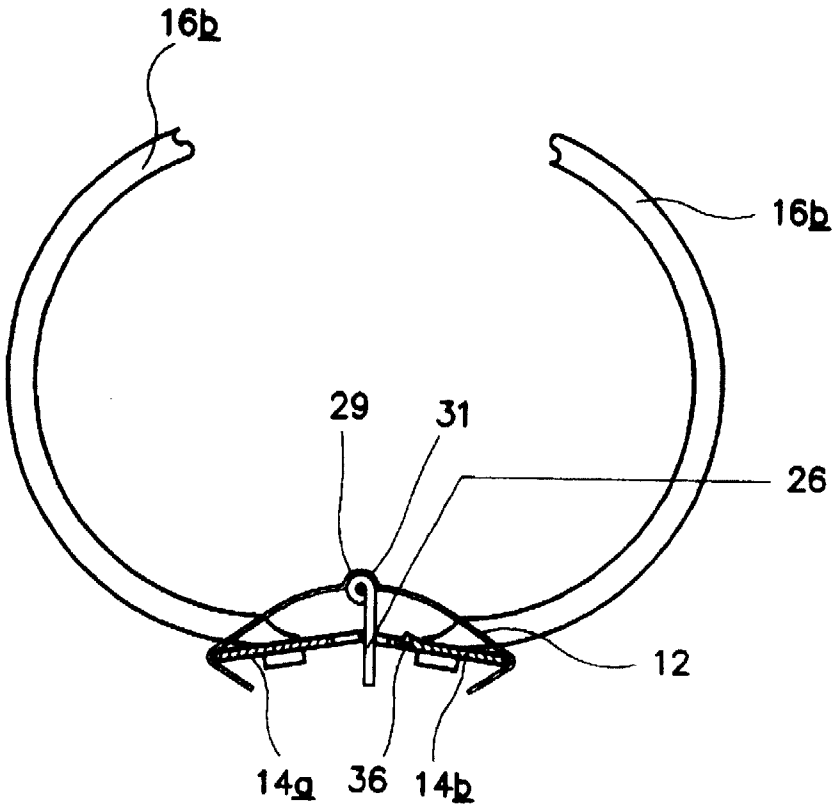
FIG. 8A shows a transverse sectional view of ring binder shown in FIG. 1 across the lock member with the half-rings in the open position.
Figure 9:
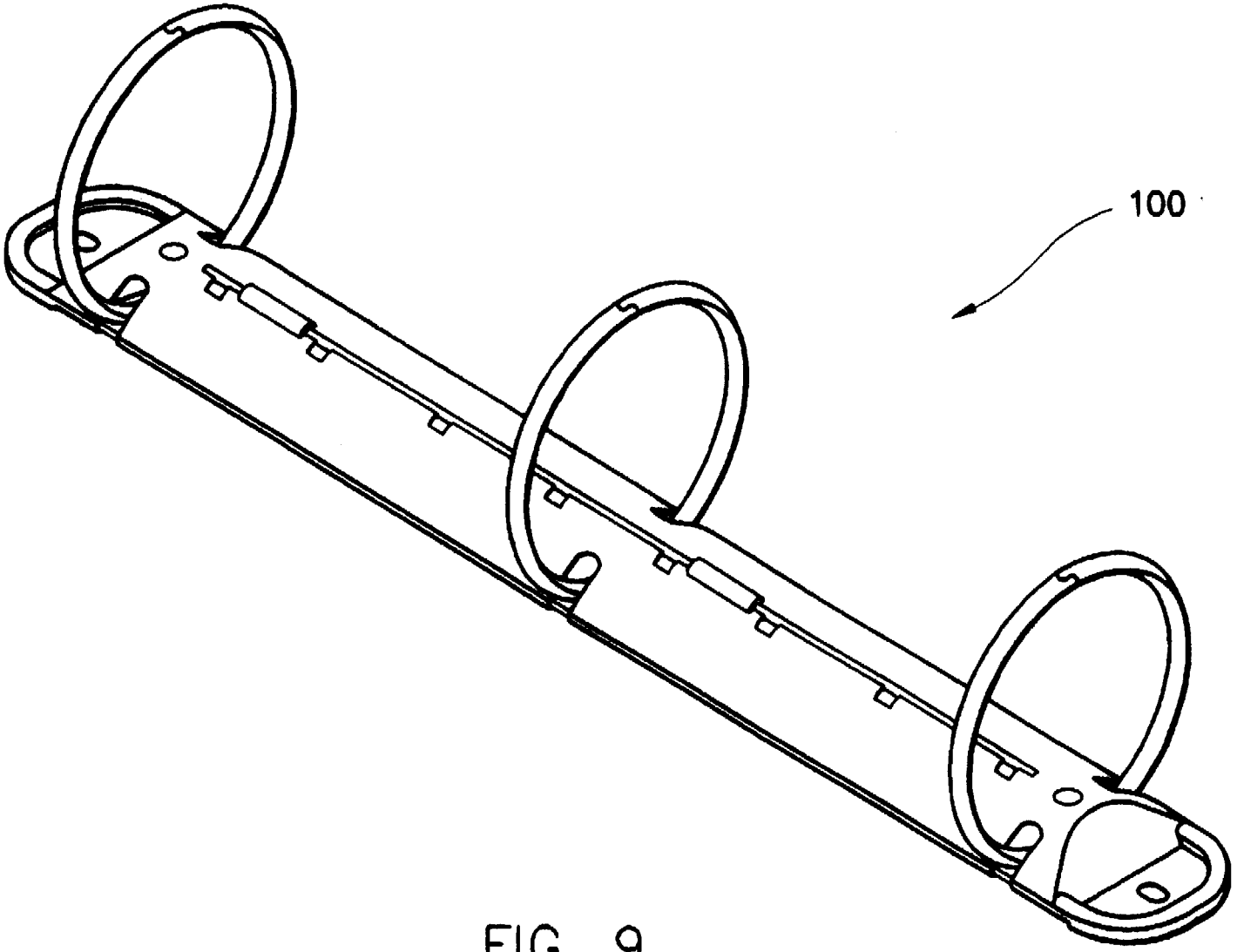
FIG. 9 shows a top perspective view of a second embodiment of a ring binder according to the present invention with the half-rings in a closed position.
Figure 10:
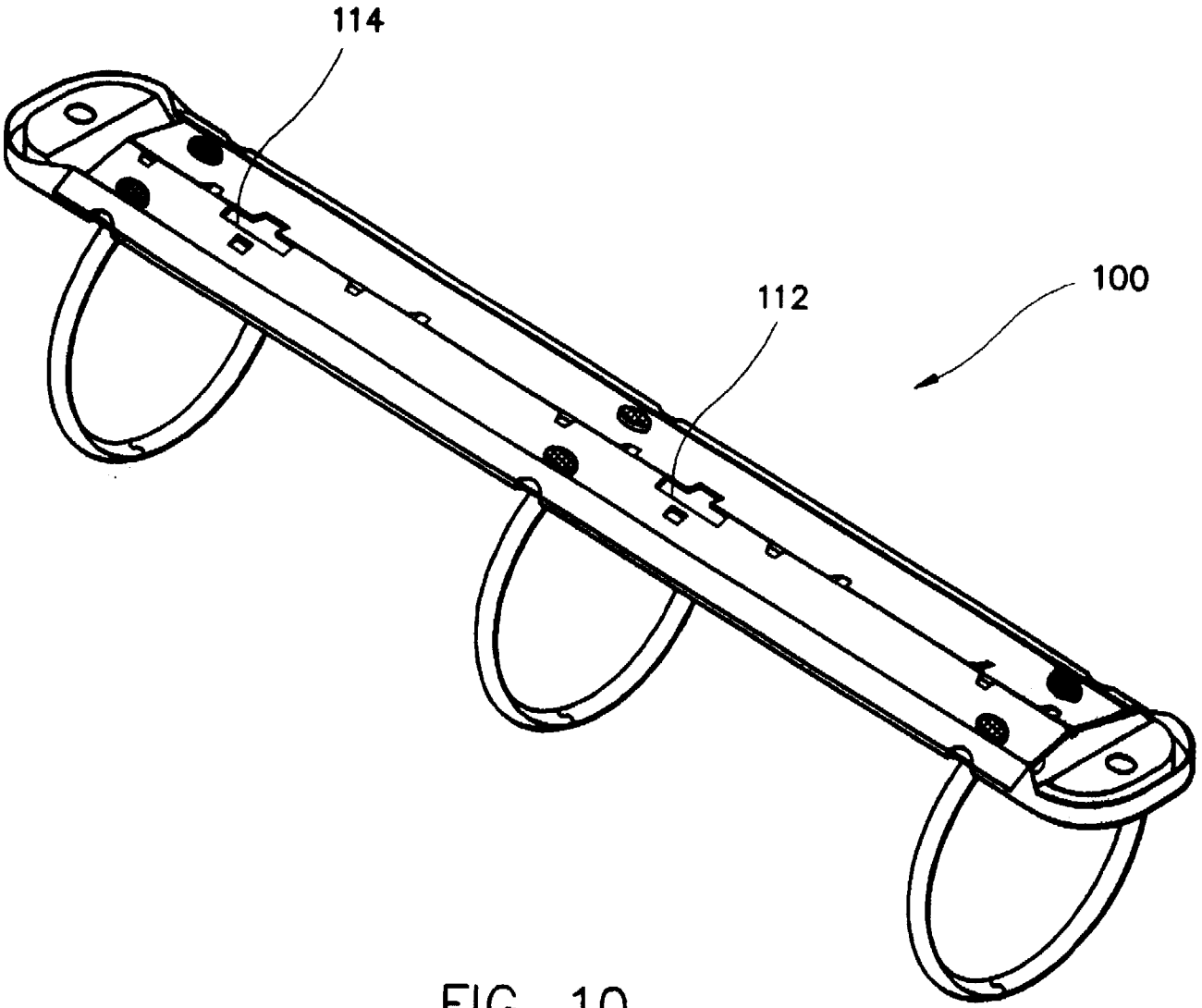
FIG. 10 shows a bottom perspective view of the ring binder shown in FIG. 9.
Figure 11:
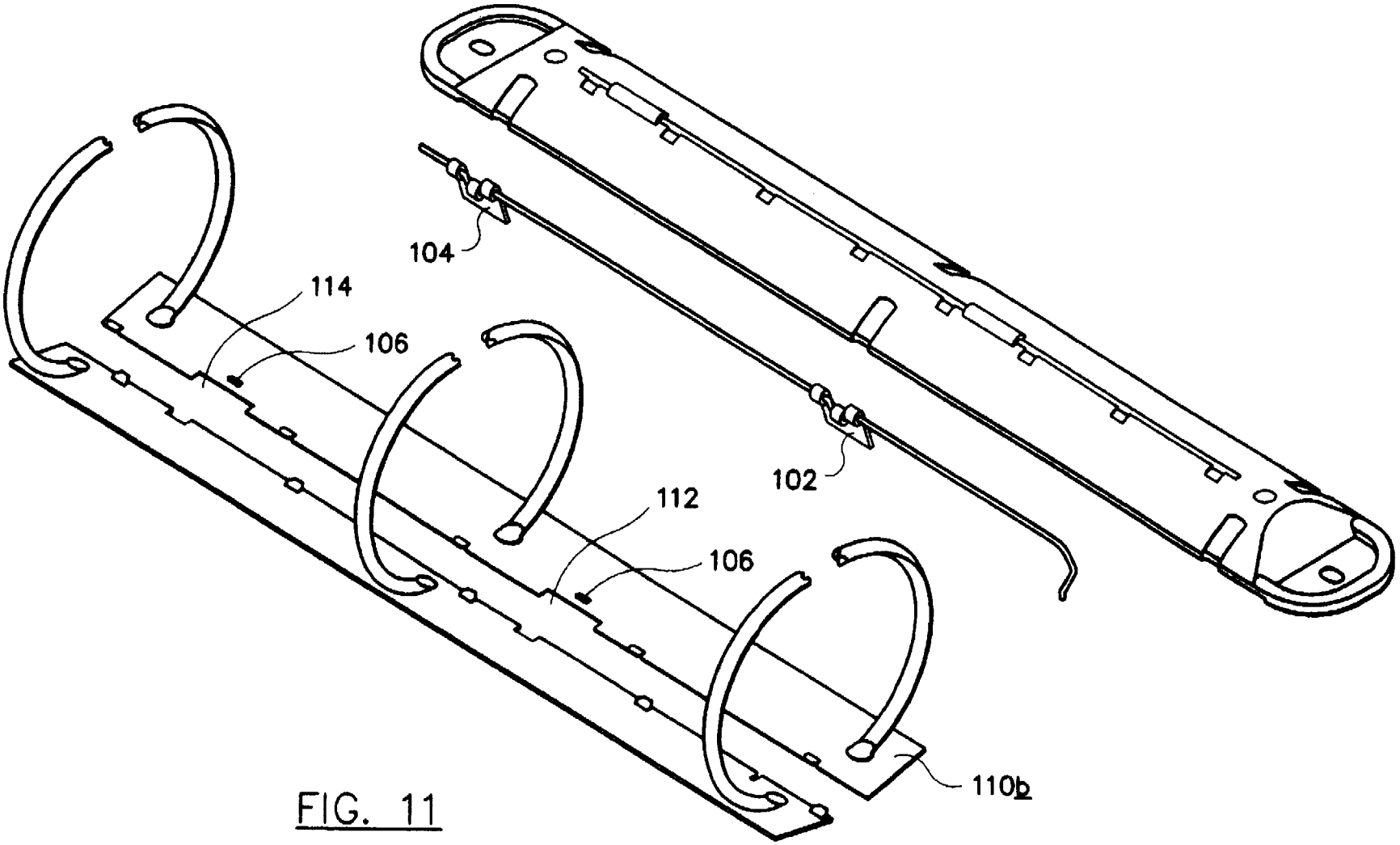
FIG. 11 shows an exploded view of the ring binder shown in FIG. 9.
Figure 12:
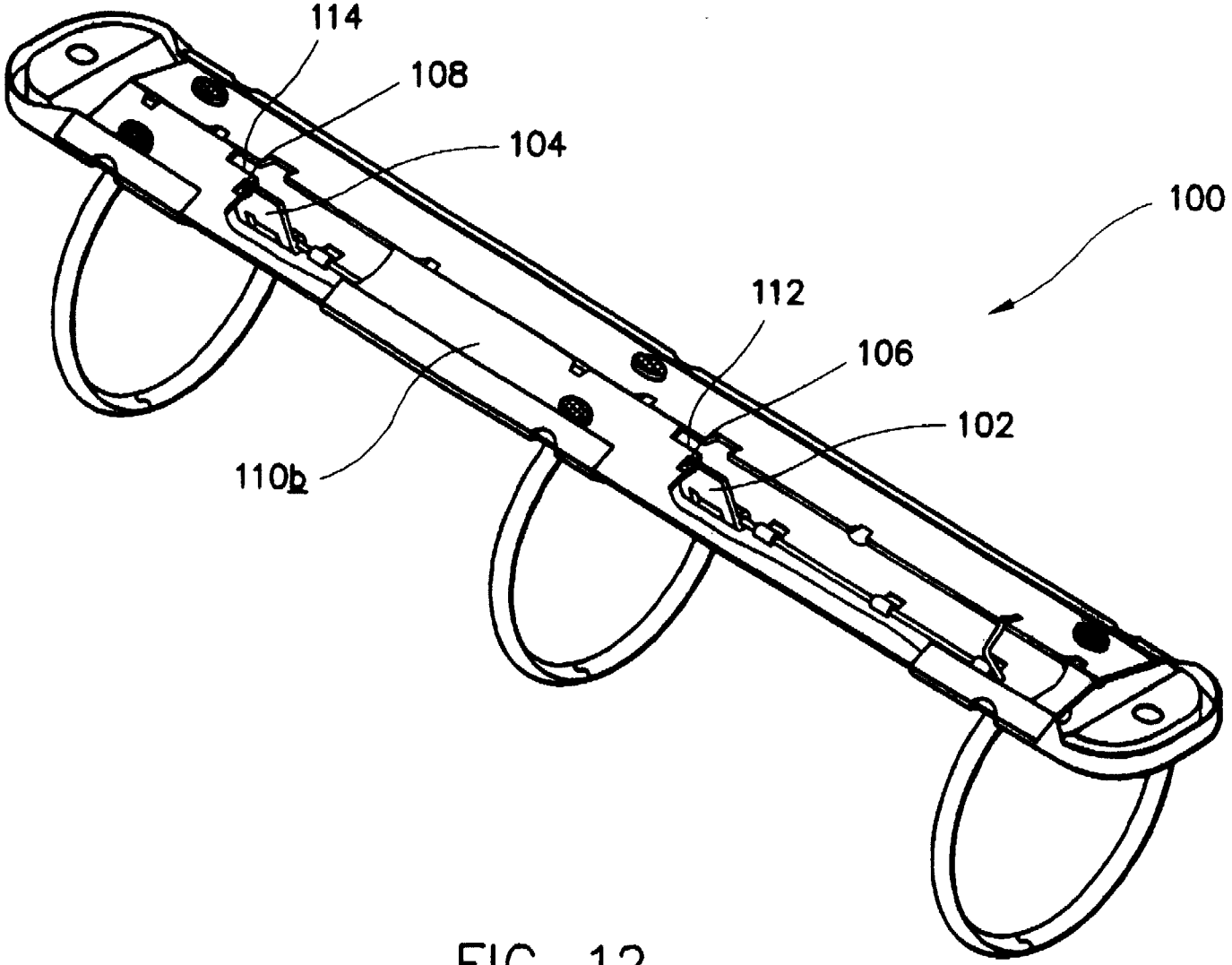
FIG. 12 shows a bottom perspective view of the ring binder shown in FIG. 9, with part of the lower structure removed for clarity purposes.
Figure 13:
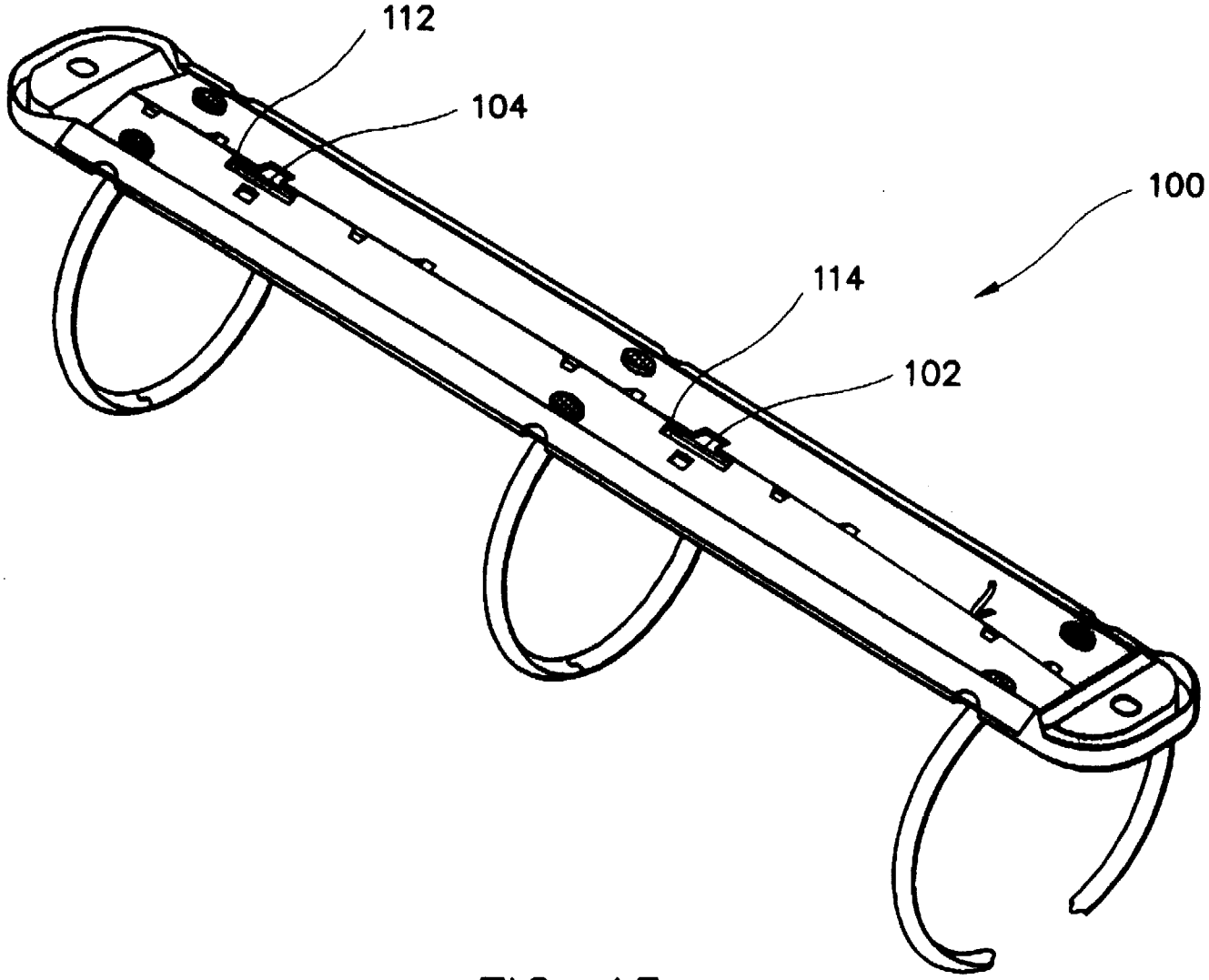
FIG. 13 shows the ring binder of FIG. 9 with its lower structure in a partly moved position.
Figure 14:
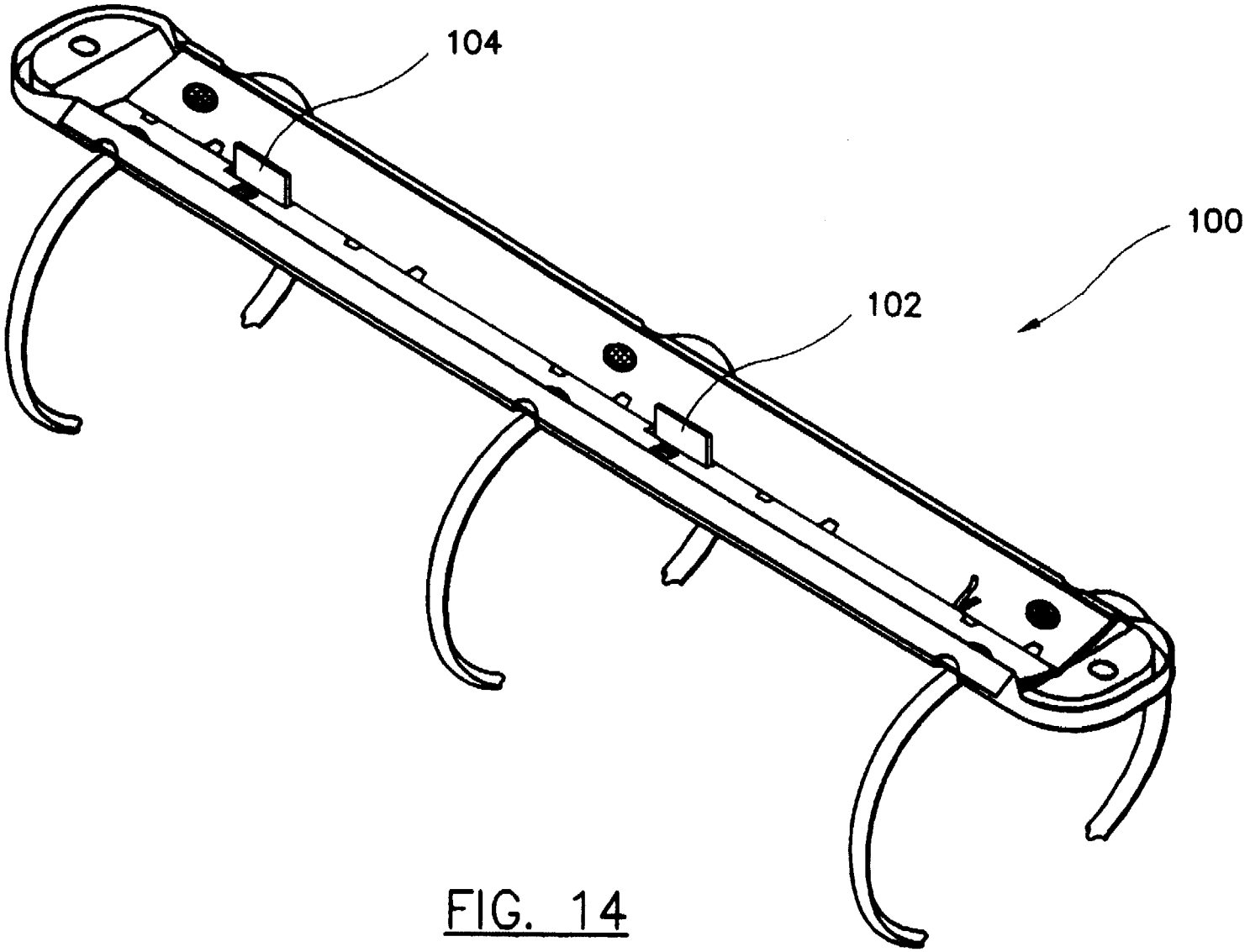
FIG. 14 shows the ring binder of FIG. 9 with the half-rings in an open position.

As shown more clearly in FIGS. 8A and 8B, the lock 22 is partly received in a channel 29 on the underside of the upper casing 12. A corresponding ridge 31 is thus formed on the upper side of the upper casing 12. This arrangement also enhances the strength of the upper casing 12, and thus the ring binder 10.

In the position when all the half-rings 16*a*, 16*b* and 16*c* are closed, as shown in FIG. 1, 2, 4, 7A and 7B, a distal end 32 of the wire 24 extends slightly through an aperture 34 of the plate 14*a*. In this position, the lock element 26 abuts against both the upper surface of the plate 14*b* and a tongue 36. In this position, any attempt to open the half-rings 16*a*, 16*b* and 16*c* by applying force to half-rings 16*b* or 16*c* will not be successful as the plate 14*b*, and consequently the plate 14*a*, is prevented from exhibiting any upward pivoting movement by reason of the lock element 26 acting against the plate 14*b*.

On the other hand, if a pulling force is applied the half-rings 16*a*, the plate 14*b* will act upon a bent portion 38 of the wire 24 from below. This will cause the lock 22 to rotate about the shaft 28 in a clockwise direction (according to FIG. 7A) to the position shown in FIG. 5. In this position, the wire 24 extends further through the aperture 34 of the plate 14*a*, and the lock element 26 is moved away from the upper surface of the plate 14*b* and the tongue 36, and aligns with an opening 40 of the plate 14*b*. Further pivoting movement of the plates 14 and 14*b*, and thus opening of all the half-rings 16*a*, 16*b* and 16*c*, are thus made possible by further pulling action on the half-rings 16*a*.

The half-rings 16*a*, 16*b* and 16*c* may be returned to the closed position by pushing together any one of the three pairs of half-rings 16*a*, 16*b* and 16*c*. When a pushing force is applied on any of the three pairs of half-rings 16*a*, 16*b* and 16*c*, the plate 14*a* will act from above on the bent portion 38 of the wire 24, so that the lock 22 is caused to rotate about the shaft 28 in an anti-clockwise direction (according to FIG. 8B) to the position shown in FIG. 7B.

The extent of return movement of the lock element 26 to its locked position is governed by the tongue 36, which prevents excessive movement of the lock element 26. This also prevents the distal end 32 of the wire 24 from being hidden in the cavity formed by the upper casing 12 and the plates 14*a* and 14*b*.

It is clear from the foregoing discussion that, in the present invention, only one pair of half-rings, namely 16*a*, can be actioned upon to cause the plates 14*a* and 14*b* to pivot, and thereby to open all the half-rings 16*a*, 16*b* and 16*c*. The ring binder 10 is thus locked from any opening movement unless this specific pair of half-rings are actioned upon. On the other hand, all the half-rings 16*a*, 16*b* and 16*c* can be actioned upon to close the binder.

FIGS. 9 to 14 show a second embodiment of a ring binder according to the present invention generally designated as 100. The major difference of this embodiment from the first embodiment discussed above is the provision of two lock elements 102 and 104. Consequently, two tongues 106 and 108 are provided on the upper surface of a plate 110*b* to govern the movements of the lock elements 102 and 104 back to the locked position, and two openings 112 and 114 are provided on the plate 110*b* for allowing part of the lock elements 102 and 104 to pass through.

Figure 15:
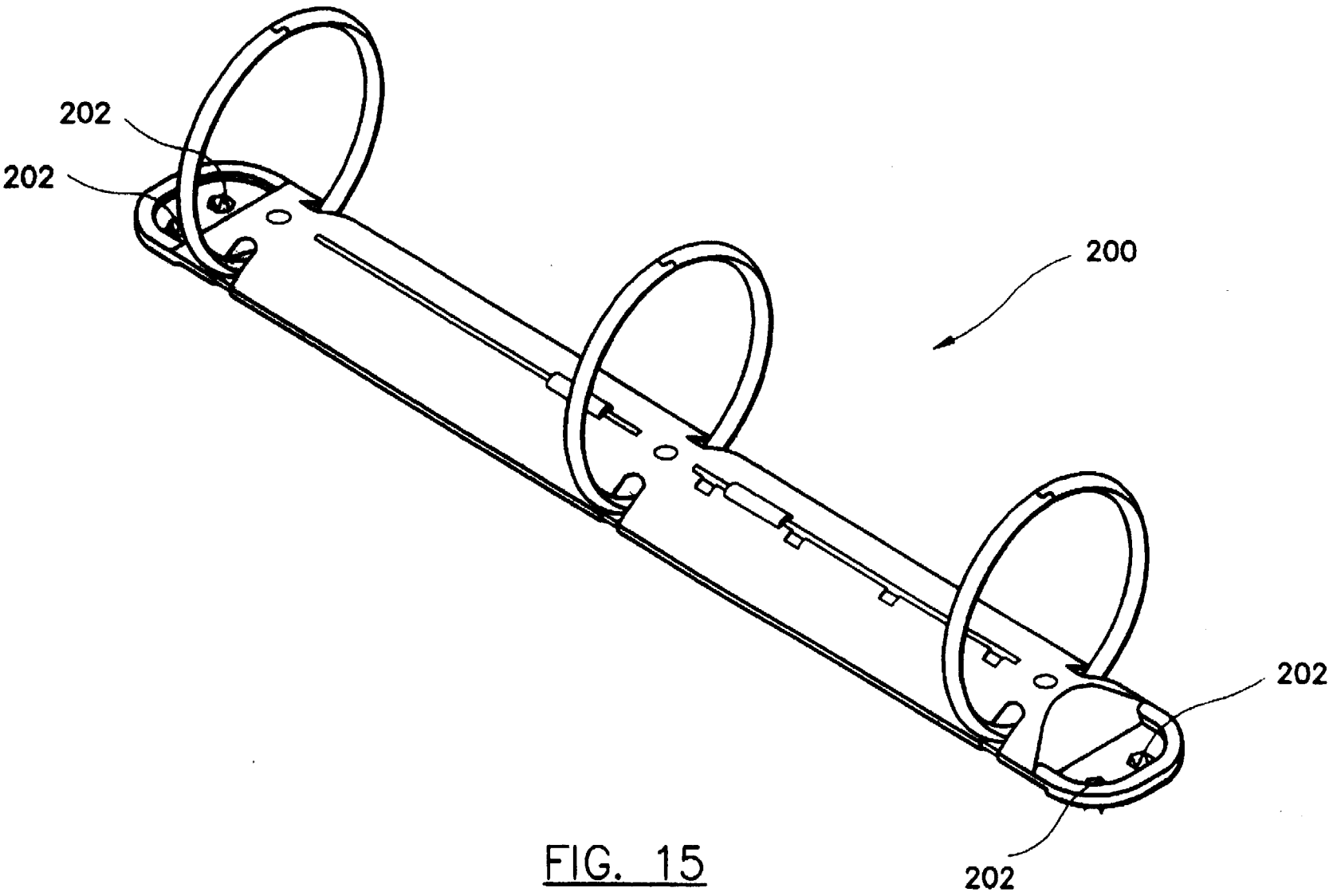
FIG. 15 shows a top perspective view of a third embodiment of a ring binder according to the present invention with the half-rings in a closed position.
Figure 16:
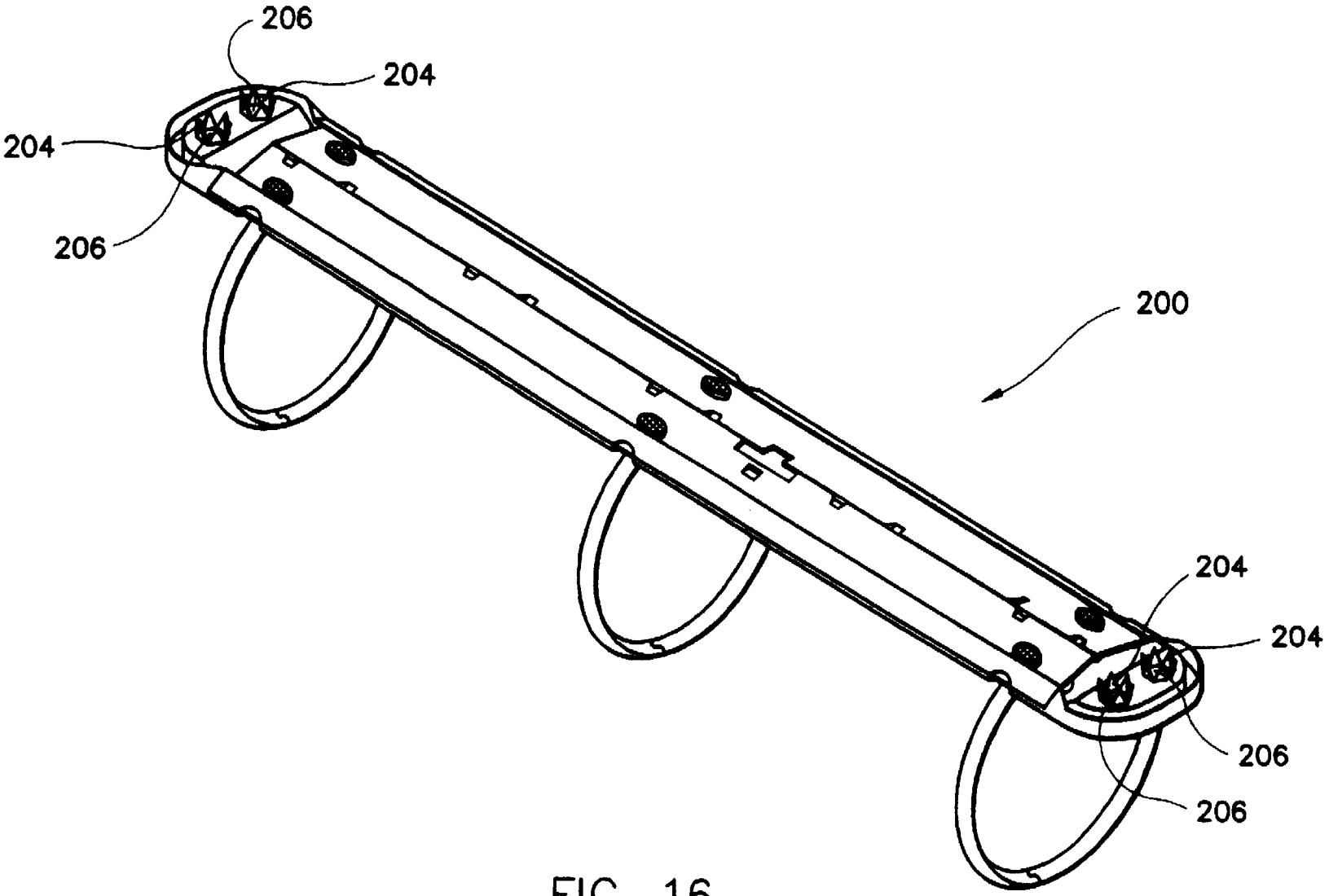
FIG. 16 shows a bottom perspective view of the ring binder shown in FIG. 15.

FIGS. 15 and 16 show a third embodiment of a ring binder according to the present invention generally designated as 200. The major difference of this embodiment from the first embodiment discussed above is the provision of two securing members 202 at each end of the ring binder 200. Each securing member 202 includes six arcuate pointed sectors 204 downwardly depending from the periphery of an orifice 206. It is thus possible to secure the ring binder 200 to a cardboard/paperboard cover without using any rivet.

It should be noted that the above only illustrates embodiments and examples in which the invention may be carried out, and that further modifications and/or alterations may be made to the examples without departing tom the spirit of the invention.

I claim:

1. A ring binder comprising a substantially rigid upper structure, said upper structure having an upper and a lower surface;

at least one inturned part protruding from the lower surface of said rigid upper structure;

a lower structure supported by said upper structure to which at least two pairs of half-ring members are mounted, said lower structure being pivotally movable between a first position in which said half-ring members are closed, and a second position in which said half-ring members are open; and at least one lock means for locking at least one of said pairs of half-ring members whilst closed, said lock means being supported by at least one of said inturned parts of said upper structure between at least two of said at least two pairs of half-ring members.

2. A ring binder according to claim 1 wherein said lock means is supported by the upper structure substantially along a longitudinal axis of the binder.

3. A ring binder according to claim 1 wherein said lock means is supported by the upper structure substantially along its middle line.

4. A ring binder according to claim 1 or 2 wherein said upper structure comprises at least one groove means for receiving therein at least part of the lock means.

5. A ring binder according to claim 4 wherein said groove means is provided in said lower surface of said upper structure.

6. A ring binder according to claim 4 wherein said upper structure comprises ridge means on said upper surface.

7. A ring binder according to claims 1, 2 or 3 wherein said lock means is swivellably movable relative the upper structure.

8. A ring binder according to claims 1 or 2 wherein said lock means is movable between a locked position in which said lower structure is locked against movement from said first position to said second position, and an unlocked position in which the lower structure is movable from said first position to said second position.

9. A ring binder according to claim 8 wherein said lock means comprises at least one lock member which, when the lock means is in its locked position, engages the lower structure against pivotal movement.

10. A ring binder according to claim 9 wherein said lock means comprises two lock members.

11. A ring binder according to claim 9 or 10 wherein at least one of said lock members, in its locked position, engages an upper surface of said lower structure.

12. A ring binder according to claim 9 or 10 wherein said lower structure comprises stopping means against which said at least one of said lock member engages when the lock means is in said locked position.

13. A ring binder according to claim 9 wherein said lower structure comprises aperture means for receiving at least part of at least one of said lock members when said lower structure moves from said first position to said second position.

14. A ring binder according to claim 8 said lock means comprises a key member operable to move the lock means from the locked position to the unlocked position.

15. A ring binder according to claim 14 wherein said key member is operable to disengage the at least one lock member from the lower structure.

16. A ring binder according to claim 15 wherein said key member is operable to disengage the at least one lock member from the upper surface of the lower structure.

17. A ring binder according to claim 14 wherein said key member is operable to disengage the at least lock member from the stopping means.

18. A ring binder according to claim 14 wherein said key member is fixedly engaged with the at least one lock member for simultaneous movement.

19. A ring binder according to claim 18 wherein said key member comprises a sloped portion upon which the lower structure acts when the lower structure moves from its first position to its second position.

20. A ring binder according to claim 19 wherein said sloped position of the key member when acted upon by the lower structure, the at least one lock member is movable from its locked position to its unlocked position.

21. A ring binder according to claim 14 wherein said lower structure comprises hole means for receiving at least part of the key member when the lower structure moves from its first position to its second position.

22. A ring binder according to claim 14 said key member comprises a wire element.

23. A ring binder according to claim 1 or 2 wherein said binder comprises securing means adapted to secure the ring binder to a base member.

24. A ring binder according to claim 23 further characterized in that the securing means is integrally formed with the upper structure.

* * * * *